United States Patent [19]

Tolley et al.

[11] 4,328,192

[45] May 4, 1982

[54] AMMONIACAL NICKEL LEACH OF LATERITES

[75] Inventors: William K. Tolley, Arlington Heights; Francisco J. Corral, Des Plaines, both of Ill.

[73] Assignee: UOP Inc., Des Plaines, Ill.

[21] Appl. No.: 140,048

[22] Filed: Apr. 14, 1980

[51] Int. Cl.[3] ..... C01G 53/00

[52] U.S. Cl. ..... 423/150; 75/119

[58] Field of Search ..... 423/144, 150; 75/119

[56] References Cited

U.S. PATENT DOCUMENTS 3,772,424 11/1973 Stevens ..... 423/150
3,845,189 10/1974 Miller ..... 423/150
4,069,294 1/1978 Stevens ..... 423/150
4,187,281 2/1980 Stauter ..... 423/150

*Primary Examiner*—Brian E. Hearn
*Attorney, Agent, or Firm*—James R. Hoatson, Jr.; Raymond H. Nelson; William H. Page, II

[57] ABSTRACT

In a hydrometallurgical process for the recovery of metal values from a metal bearing source in which a metal bearing source is treated at a temperature in the range of from about 300° to about 900° C. in a reducing atmosphere in contact with an additive such as a hydrogen halide and sulfur followed by cooling and extracting the source with a basic or acidic solution, the recovery of the desired metal value may be improved by adding the hydrogen halide to the source at a temperature below about 500° C.

6 Claims, No Drawings

AMMONIACAL NICKEL LEACH OF LATERITES

BACKGROUND OF THE INVENTION

In the processing of materials containing metal values two of the main extractive methods to be considered are pyrometallurgy and hydrometallurgy. In the former, metal-containing material such as ore, slag, scrap, etc., is heated with appropriate agents such as reducing agents, fluxing agents, sulfidizing agents, chloridizing agents and/or oxidizing agents, etc., usually to the melting or fusion point of the mixture. At this temperature there is generally a separation of metallic values from gangue or waste materials. The procedure then calls for separating the metallic values from slag or waste material at a temperature at which both are molten. The phase containing the metal value is then cast to some convenient shape for use or for further refining, whichever is appropriate for the particular system involved. The very high temperatures involved in this technique are achieved via electric furnaces, blast furnaces, reverberatory furnaces, etc. Temperatures required for metals such as copper, nickel, iron would generally range from 2000° F. to 3500° F. An advantage in this method is that recoveries of the metal values are typically quite high.

The hydrometallurgy approach differs substantially from pyrometallurgy in that, although the metal bearing material such as ore, slag, scrap, etc., may be heated with agents such as reducing agents, oxidizing agents, sulfatizing and chloridizing agents as part of the procedure, the temperatures involved are generally much lower than with the usual pyrometallurgical method. These temperatures typically may be 500° F. to 1900° F., temperatures generally well below the fusion point of the metal-containing material.

Following this step, the treated metal-containing material is then contacted with an appropriate aqueous solution for extracting metal values by dissolution. The metal is then removed from the solution by precipitation, solvent extraction, evaporation of solvent, etc. The metal-containing residue obtained is then handled appropriately to further refine the metal. Although conditions of temperature are generally much lower than in pyrometallurgy, it is frequently found that recovery of the metal values is also lower than in the pyrometallurgical method.

A particular case where this is true concerns the extraction of nickel from lateritic nickel ores. The pyrometallurgical processes range from the use of an electric furnace for the direct smelting of ore to produce ferronickel through similar techniques involving the blast furnace in which an iron-nickel-sulfide matte is obtained. The extraction of nickel from the ore using this method is greater than 90%.

Of the several hydrometallurgy approaches used commercially for treating this type of ore, the practice on a highly serpentinic ore, such as at Nicaro, Cuba, involves roasting the ore in a multihearth furnace while a reducing gas, such as producer gas, passes countercurrent to the ore. Temperatures in this case range from about 900° to about 1350° F. Following the roasting step, the ore is cooled in the absence of air, mixed with an ammoniacal ammonium carbonate solution and vigorously agitated and aerated. This results in the dissolution of nickel and cobalt, separating them from the bulk of the ore. This solution then is treated with steam, driving off ammonia and precipitating nickel carbonate.

This product then is treated further to obtain the appropriate form of nickel or used as such. In contradistinction to the pyrometallurgical process, however, extractions using this method have only been of the order of 70 to 80 percent.

Several other hydrometallurgy methods involve the use of procedures which include a roasting step with chlorides or sulfates but in other than reducing atmospheres, and the roasted ore is leached with an appropriate solvent such as dilute sulfuric acid. Alternatively, in certain cases the ore can be leached directly, such as with sulfuric acid solution but this is practical only when the magnesia content of the ore is low. It recently has been found that improved extraction of metal values is obtained when the reductive roast is effected in the presence of added sulfur. While this method considerably improves recovery of metal values, it still is desirable to provide other methods for effecting improved recovery of metal values, as well as means to further increase such recovery.

DESCRIPTION OF THE INVENTION

This invention relates to an improvement in the hydrometallurgical extraction of metal values from a metal bearing source. More specifically, the invention is concerned with the method for the hydrometallurgical recovery of metal values such as nickel from a metal bearing source containing a mixture of various metals.

In the hydrometallurgical extraction of metal values, the obtention of desired yields of metal values may be improved when the reductive roast of the metal bearing source is effected in the presence of additives of the type hereinafter set forth in greater detail. These additives comprise hydrogen halides or precursors thereof as well as sulfur-containing compounds, the combination of the two additives resulting in a greater yield of the metal values. By utilizing these additives, it is possible to recover the desired metal value in yields greater than those which were heretofore obtained in the hydrometallurgical system which was effected in the absence of the added hydrogen halides or sulfur-containing compounds. In addition to obtaining greater yields by utilizing these additives, it is also possible to effect the process in a shorter period of time. For example, high recoveries may be obtained in 30 minute roasting times which is in contrast to the requirements of greater than 1 hour when the reducing treatment is effected in the absence of these additives. In addition, it has now been discovered that the yields of desired metal values may be further improved by effecting the addition of the hydrogen halide additive to the metal source during the early stages of the roasting step and at temperatures lower than about 500° C.

It is therefore an object of this invention to provide an improvement in the hydrometallurgical recovery of metal values from a metal bearing source.

In one aspect an embodiment of this invention resides in a process for the recovery of metal values from a metal bearing source which comprises treating said source at a temperature in the range of from about 300° to about 900° C. in a reducing atmosphere and in contact with at least one additive selected from the group consisting of hydrogen halide and a sulfur-containing compound, cooling the thus treated source, extracting the cooled source with a basic or acidic solution, and recovering the resultant metal value, the improvement which comprises adding said hydrogen halide to said source at a temperature below about 500° C.

A specific embodiment of this invention is found in a process for the recovery of metal values from a metal bearing source which comprises treating a metal bearing source such as a lateritic ore in a reducing atmosphere, adding hydrogen chloride to the ore at a temperature below about 500° C., thereafter roasting the ore at a temperature in the range of from about 500° to about 900° C., cooling the treated ore, extracting the cooled ore with an ammoniacal ammonium carbonate solution, and recovering the resultant nickel value.

Other objects and embodiments will be found in the following further detailed description of the present invention.

As hereinbefore set forth the present invention is concerned with a method for the hydrometallurgical recovery of metal values from a metal bearing source. The term "metal bearing source" as used in the present application and appended claims will refer to sources such as ore, slag, scrap, etc. In the interest of brevity, it is to be understood that reference to ore in the present specification will also include reference to the other metal bearing sources hereinbefore set forth. The improved process for the recovery of a desired metal value is particularly applicable to the recovery of nickel from such sources. However, it is to be understood that the process may also be used for the recovery of other metal values including, for example, copper, cobalt, manganese, etc.

The hydrometallurgical recovery of metal values may be effected utilizing conventional apparatus and in addition may utilize some conventional steps which have been set forth in prior art processes. Accordingly, the ore such as a lateritic nickel ore or other metal bearing source is first prepared in a manner suitable for the process, whereby the ore is subjected subject to treatment in order to form finely divided or comminuted particles, said grinding or other treatment being any which are well known in the art. The particles may be within a size range of from 35 to about 325 mesh or less and preferably within a range of from about 48 to about 200 mesh. The ground particles are then dried in a conventional manner in order to lower the moisture content of said particles of from about the usual 25 to 50% down to about 8 to 10% or less. The drying step is generally effected by treating the particles in a rotary kiln at conventional temperatures.

Following the drying of the particles, said particles are then roasted at a temperature in the range of from about 300° up to about 900° C., said roasting being effected in a reducing atmosphere and in contact with at least one additive, the presence of said additive preventing the incorporation of nickel into a phase which will make it unavailable and which will at a later point enable the nickel to be recovered from the extraction step in a higher percentage. By roasting the ore in a reducing atmosphere in the presence of additives at this temperature, the magnesium compounds which are present will be prevented from converting to magnesium silicate in the form of forsterite, which formation usually acts to reduce the amount of nickel in an extractable form. The reducing zone in which the ore is roasted may be of conventional nature and may include, for example, a multihearth furnace, a fluo-solids roaster, a Herreshoff furnace, etc. The reduction of the ore is effected by means of a suitable reducing gas mixture which, if so desired, may be of the general type which is used in conventional processes. Any suitable reducing gas mixture may be used and preferably comprises a mixture of hydrogen, carbon monoxide, carbon dioxide and water vapor. The gaseous mixture may come from any suitable source such as producer gas, gases formed by the combustion of city gas, gases formed by combustion of oil, etc. The specific gaseous mixture will be selected to effect the desired reduction of the nickel compounds to an extractable state. As an example, an illustrative gas mixture comprises a $CO:CO_2$ ratio within the range of from about 0.1 to 10:1, a $CO:H_2$ ratio of from about 0.1:1 to 10:1 and a $H_2:H_2O$ vapor ratio of from about 1.1:1 to 10:1, all being on a volumetric basis. In one embodiment, it is desirable to maintain the gas mixture within the ratios set forth above because an excessive concentration of one or more of the components in the gas mixture may have undesired effects such as, for example, incomplete reduction of the metal compound to the metallic state, excessive absorption of the gas in the ore particles, etc. It is to be understood that the gas mixture may contain other components as, for example, nitrogen, when advantages appear therefor. Other illustrative gas mixtures comprise hydrogen, nitrogen and water vapor or natural gas.

The roasting of the ore in a reducing atmosphere is effected in the presence of at least one additive, and preferably a combination of additives. One of the additives which is present in the roasting step comprises a hydrogen halide, examples of hydrogen halides which may be employed including hydrogen halide gases such as hydrogen chloride gas, hydrogen bromide gas, hydrogen iodide gas, or hydrogen fluoride gas, the latter two being used but not necessarily with equivalent results. It is also contemplated within the scope of this invention that precursors of hydrogen halide may be introduced into the roasting zone in a manner hereinafter set forth in greater detail and converted to hydrogen halide. Some examples of these precursors which may be employed will include boron trichloride, boron tribromide, boron trifluoride, carbon tetrachloride, carbon tetrabromide, carbon tetrafluoride, phosphorous tribromide, phosphorous pentachloride, phosphorous trifluoride, phosphorous pentaiodide, silicon tetrachloride, silicon tetrabromide, methyl chloride, methylene chloride, methyl bromide, methylene bromide, methyl iodide, ethyl chloride, dichloroethylene, dibromoethylene, vinyl chloride, vinyl bromide, etc. At the relatively high temperatures which are encountered in the roasting step, the precursor will be decomposed to liberate the hydrogen halide or the halogen which is then reduced to the hydrogen halide form. Other additives which are employed will include sulfur or sulfur compounds. The sulfur may be in gaseous form or may be in solid form including powder, flour, granules, pellets, etc., or molten or otherwise liquefied sulfur. Examples of sulfur-containing compounds will include pyrite, methyl xanthate, ethyl xanthate, propyl xanthate, butyl xanthate, pentyl xanthate, hexyl xanthate, etc., or metal salts thereof such as sodium methyl xanthate, potassium methyl xanthate, calcium ethyl xanthate, sodium propyl xanthate, sodium butyl xanthate, sodium hexyl xanthate, potassium hexyl xanthate, etc. When utilizing sulfur as the additive the sulfur may be admixed with the ore at an elevated temperature as it is being withdrawn from the drying step. The sulfur is usually present in an amount ranging from a concentration of from about 0.1 to about 5% and preferably from about 0.15 to about 3% by weight of the ore. It is to be understood that any suitable means of introducing the sulfur-containing compound into the reducing zone may be utilized.

As hereinbefore set forth, it has now been discovered that by effecting the addition of the hydrogen halide compound at a relatively low temperature it is possible to attain improved yields of the desired metal value. While the reductive roast of the metal bearing source is effected at temperatures in the range hereinbefore set forth, that is, from about 300° to about 900° C. the hydrogen halide which is to constitute one of the additives present in the reductive roast is added during the initial stages of the roast and preferably is added at a period prior to the point at which the temperature of the roasting step reaches about 500° C., and preferably at a temperature within the range of from about 360° to about 500° C. The concentration of hydrogen halide which is used as an additive in the roasting step will range from about 0.001 to about 2% and preferably from about 0.01 to about 1.5% by weight of the source such as an ore. In the event that the hydrogen halide is in gaseous form, it may be added in any suitable manner including direct addition to the hydrogen halide gas into the roasting zone. In the event that the hydrogen halide is in aqueous form such as hydrochloric acid, hydrobromic acid, etc., the reducing gas of the composition hereinbefore set forth may be bubbled through an aqueous solution of the hydrogen halide and thus the hydrogen halide is carried into the reducing zone in this manner. In another embodiment the free halogen such as chlorine, bromine, etc., may be injected directly into the roasting zone wherein, upon contact with the reducing gas, it may be rapidly converted to the corresponding hydrogen halide. By adding the hydrogen halide additive to the reduction zone in such a manner and at such a temperature, that is, below about 500° C., it is possible, as will hereinafter be shown in greater detail, to obtain an improved extraction yield of desired metal values such as nickel.

After roasting in the reducing atmosphere and in contact with additives such as those hereinbefore set forth, the particles are withdrawn from the reducing zone, cooled and processed in a conventional manner for the hydrometallurgical extraction of the desired metal value such as nickel, cobalt, etc. The cooling is done by reducing the temperature several hundred degrees preferably under a nitrogen blanket in order to avoid the possibility of oxidation of the metals to the oxide or to other oxygen-containing forms. The leaching of the metal value may be effected in either a basic or acidic solution. For example, the quench liquid which is employed may comprise an ammoniacal ammonium carbonate or an ammoniacal ammonium chloride solution while the acidic solution may comprise aqueous inorganic acids such as hydrochloric acid, hydrobromic acid, nitric acid, phosphoric acid, sulfuric acid, the preferred acids being hydrochloric or sulfuric due to the greater availability thereof. In addition, the quenching or leaching of the metal source is also effected in the absence of oxygen in order to avoid the possibility of the oxidation of the metal. The leaching of the metal source is effected at temperatures below about 95° C. and is preferably effected at ambient temperature. After leaching for a period of time which may range from about 30 minutes to about 2.5 hours or more, the solution of the desired metals is withdrawn from the leaching or extraction zone and thereafter treated in any suitable manner to precipitate the desired metal values such as nickel, cobalt, etc., and to recover the same. One method of accomplishing this precipitation, when utilizing a basic leach, is to steam heat the solution to precipitate the nickel carbonate and to volatilize off ammonia, carbon dioxide and water. Other methods will include neutralization, cementation, solvent extraction, electrolysis, etc.

As will hereinafter be shown in greater detail by utilizing the process of the present invention including the introduction of the hydrogen halide to the metal source at a temperature below about 500° C., it will be possible to attain a greater yield of the desired metal than is possible when treating the metal source during the roasting step in a reducing atmosphere at a temperature above 500° C.

The following examples are given for purposes of illustrating the process of this invention. However, it is to be understood that these examples are merely illustrative in nature, and that the present invention is not necessarily limited thereto.

EXAMPLE I

A series of experimental runs was made utilizing a lateritic ore having the following assay:

| | % |
|---|---|
| Ni | 1.24 |
| CO | 0.14 |
| Fe | 36.9 |
| $SiO_2$ | 14.7 |
| $Al_2O_3$ | 2.1 |
| MgO | 5.4 |

In the first series 50 gram samples were mixed with 0.5 grams of sulfur and placed in a quartz furnace tube. The tube was then purged with nitrogen and placed into a furnace which was preheated to 360° C. and roasted for a period of 10 minutes. After being roasted at 360° the ore was roasted for a second 10 minute period at this temperature under a flow of reducing gas having the following composition:

| Gas | Ml/Min. |
|---|---|
| $N_2$ | 369 |
| $H_2$ | 291 |
| $CO_2$ | 214 |
| CO | 97 |
| $H_2O$ | 2 |

In addition 40 ml/min. of hydrogen chloride was added to this gas stream. At the end of the 10 minute period the introduction of hydrogen chloride was discontinued and the temperature was increased at a constant rate from 360° to 780° C. during a period of 33 minutes. Upon completion of the 33 minute reduction period the furnace tube was removed from the furnace and cooled while maintaining the reduced ore sample under a slight flow of dry nitrogen. After cooling, the reduced ore was transferred to leaching under a nitrogen pressure and leached for a period of 2.5 hours utilizing ammoniacal ammonium carbonate as the leaching agent. At the end of the 2.5 hour period during which the slurry was vigorously agitated, the mixture was filtered, the filtrate was then assayed for nickel content which disclosed a 91.5% extraction of the nickel.

When the experiment was repeated two more times and the hydrogen chloride gas was charged during the first 10 minute roast at 360° C. in the first run and in the second run was charged to the furnace during the first portion of the 33 minute reduction period while the furnace temperature was being raised from 360° to 500° C., nickel extractions of 91.2% and 90.3% were obtained.

EXAMPLE II

The above experimental runs were again repeated by treating a lateritic ore of the composition set forth in Example I above to a reductive roast utilizing a reducing gas of the same composition as hereinbefore set forth. Again the lateritic ore was placed in a quartz furnace tube after admixture with sulfur, the tube was purged with nitrogen and placed into a furnace which had been preheated to 360° C. After roasting the ore for a period of 10 minutes the reducing gas was charged thereto and the ore again roasted for a period of 10 minutes at this temperature. The temperature of the furnace was then raised at a constant temperature rate from 360° to 780° C. During the last two 10 minute periods of the roast during which time the temperature of the ore was in a range of from 500° to 780° C. 40 ml/min. of hydrogen chloride was added to the gas stream which was passing over the lateritic ore. In the first run during which time the hydrogen chloride gas was passed during the middle 10 minute period of the 33 minute reduction period, analysis of the ore which was recovered after ammoniacal ammonium carbonate leaching disclosed that there had been an 88.5% extraction and when the hydrogen chloride gas was passed into the reductive roast during the last 10 minute period when the temperature was approaching 780° C., there was an 88.3% extraction of the nickel.

EXAMPLE III

As a comparison the above experimental run was repeated utilizing a lateritic ore of similar composition and a reducing gas of similar composition to those hereinbefore set forth. Similar conditions were employed to those hereinbefore set forth in the above examples. However, the difference was that the hydrogen chloride additive was charged to the furnace during the entire 30 minute reduction period during which time the temperature was being raised from 360° C. to 780° C. Assay of the filtrate after treating the ore to an ammoniacal ammonium carbonate leach for a period of 2.5 hours determined that there had been a 91.0% nickel extraction. It is to be noted that this is the same extraction for nickel that had been obtained when the ore was chlorinated for only the first 10 minutes of the reduction ore when the hydrogen chloride was added in either prior 10 minute period, each addition being made when the temperature was in a range of from 360° to 500° C. This illustrates the fact that short periods of exposure to the additive at relatively low temperatures result in the extraction of a similar amount of nickel as can be obtained when subjecting the ore to longer periods of exposure to additive at higher temperatures, that is, above about 500° C. By utilizing the process of the present invention, it is possible to effect a similar extraction of nickel using a smaller amount of hydrogen halide additive thus reducing the expense of the entire operation with the concurrent recovery of metal values at a lower cost.

We claim as our invention:

1. A process for the increase in the recovery of nickel metal values from a lateritic ore which comprises treating said ore first with at least one additive selected from the group consisting of hydrogen halide, elemental sulfur and a sulfur containing compound in a reducing atmosphere at a temperature beginning at about 360° C. and extending to below 500° C. for a period of time of not less than 10 minutes while said temperature is held to below 500° C. and then increasing said temperature after said passage of not less than 10 minutes up to about 900° C., cooling said treated ore and additive, extracting said increased amount of nickel metal values from said treated and cooled ore with a basic ammoniacal leaching solution, and recovering said resultant increased amount of nickel metal values.

2. The process as set forth in claim 1 in which said hydrogen halide is hydrogen chloride.

3. The process as set forth in claim 1 in which said hydrogen halide is hydrochloric acid.

4. The process as set forth in claim 1 in which said elemental sulfur is gaseous sulfur.

5. The process as set forth in claim 1 in which said basic leaching solution is an ammoniacal ammonium carbonate.

6. The process as set forth in claim 1 in which said basic leaching solution is an ammoniacal ammonium chloride.

* * * * *